US010532370B2

(12) United States Patent
Schrum et al.

(10) Patent No.: US 10,532,370 B2
(45) Date of Patent: Jan. 14, 2020

(54) PORTABLE PRESSURIZED SPRAYER

(71) Applicants: Phillip B. Schrum, Clairton, PA (US); Mark A. Verosky, Elizabeth, PA (US); David A. Krygowski, North Huntingdon, PA (US)

(72) Inventors: Phillip B. Schrum, Clairton, PA (US); Mark A. Verosky, Elizabeth, PA (US); David A. Krygowski, North Huntingdon, PA (US)

( * ) Notice: Subject to any disclaimer, the term of this patent is extended or adjusted under 35 U.S.C. 154(b) by 145 days.

(21) Appl. No.: 15/299,119

(22) Filed: Oct. 20, 2016

(65) Prior Publication Data

US 2017/0106385 A1 Apr. 20, 2017

Related U.S. Application Data

(60) Provisional application No. 62/243,862, filed on Oct. 20, 2015.

(51) Int. Cl.

| | |
|---|---|
| ***B05B 9/08*** | (2006.01) |
| ***B05B 9/043*** | (2006.01) |
| ***B05B 9/04*** | (2006.01) |
| ***B05B 15/62*** | (2018.01) |
| ***B05B 15/63*** | (2018.01) |

(52) U.S. Cl.

CPC ..... *B05B 9/043* (2013.01); *B05B 9/0406* (2013.01); *B05B 9/0805* (2013.01); *B05B 9/0816* (2013.01); *B05B 9/0888* (2013.01); *B05B 15/62* (2018.02); *B05B 15/63* (2018.02)

(58) Field of Classification Search

CPC ..... A01C 15/00; A01C 15/04; A01C 17/00; A01C 7/02; A01C 7/081; A01C 7/085; B05B 9/007; B05B 9/043; B05B 9/0805; B05B 9/085; B05B 9/0861; B05B 9/0877; B05B 9/0883; B05B 9/0888; B05B 9/0855; B05B 9/0866; B05B 9/0872

USPC ..... 239/154, 373, 152, 153; 222/175; 224/148.1–148.7; 417/234

See application file for complete search history.

(56) References Cited

U.S. PATENT DOCUMENTS

| | | | | |
|---|---|---|---|---|
| 4,651,903 A * | 3/1987 | Pagliai | A01M 7/0046 | 222/175 |
| 5,695,121 A * | 12/1997 | Stillions, Jr. | A01M 7/0035 | 239/126 |
| 7,556,210 B2 * | 7/2009 | Mandell | B05B 7/0093 | 239/147 |
| 7,967,222 B2 * | 6/2011 | Alexander | B08B 3/026 | 239/146 |

(Continued)

*Primary Examiner* — Alexander M Valvis
(74) *Attorney, Agent, or Firm* — Cohen & Grigsby, P.C.

(57) ABSTRACT

A tank holding a quantity of liquid releasably connects to a portable pump assembly through a connector to provide a portable sprayer. The tank connects to a feed line that supplies spray nozzle with the liquid. The connector combines a quick disconnect connector with a pressure relief valve. The portable pump assembly includes an electric pump, a switch assembly, and a check valve. The portable pump assembly directs gas through the check valve into the connector to increase the gas pressure in the tank and force the liquid in the tank to flow through the feed line and out the spray nozzle. The switch assembly turns off the electric pump when the gas pressure in the tank exceeds a predetermined limit while maintaining the flow of liquid through the spray nozzle.

19 Claims, 16 Drawing Sheets

(56) References Cited

U.S. PATENT DOCUMENTS

| | | | | |
|---|---|---|---|---|
| 7,971,803 | B1 * | 7/2011 | Barlowe | B05B 9/007 222/333 |
| 8,979,001 | B2 * | 3/2015 | Peterson | B05B 9/01 239/146 |
| 8,998,110 | B2 * | 4/2015 | Nishimura | A01C 23/047 239/303 |
| 2004/0079816 | A1 * | 4/2004 | Daniel, Jr. | A01M 7/0046 239/200 |
| 2006/0231561 | A1 * | 10/2006 | Choi | A45F 3/20 220/714 |
| 2006/0249539 | A1 * | 11/2006 | Wempe | A63B 55/00 222/192 |
| 2011/0057436 | A1 * | 3/2011 | Schrum | B05B 9/0406 285/33 |

* cited by examiner

PORTABLE PRESSURIZED SPRAYER

CROSS REFERENCE TO RELATED APPLICATIONS

The present application claims the benefit under 35 U.S.C. § 119(e) of prior U.S. Provisional Application No. 62/243,862 filed Oct. 20, 2015, having the title "PORTABLE PRESSURIZED SPRAYER", the disclosure of which being incorporated herein by reference in its entirety.

BACKGROUND OF THE INVENTION

1. Field of the Invention

This invention relates a method and apparatus for spraying liquids and, more particularly, to a portable sprayer that includes a detachable electric pumping module and a manual back-up pump.

2. Description of the Related Art

A common item on the market today is a container that is manufactured and sold for spraying liquids. Generally, liquids are sprayed to atomize or to produce fine droplets in the air that impinge on a surface. The number of applications for liquids that are dispensed by spraying is virtually unlimited.

For this reason, many liquids are sold in containers that have an attached hand operated sprayer. The sprayer has a trigger or lever which, when manually activated, atomizes or dispenses liquid in small droplets. These manually-activated sprayers require the user to sequentially squeeze a lever or a trigger. To maintain a uniform spray pattern, a user must operate the lever or trigger rapidly while at the same time moving the container, if a large area is to be covered.

Many liquids are sold in bottles with a removable cap so that a sprayer can be attached to the container with the idea that the hand-held sprayer can be repeatedly used for different containers.

U.S. Pat. No. 7,032,841 discloses a hand-held battery power sprayer assembly having a container and a body. The sprayer assembly also includes a battery powered pump connected in series to a switch and a battery. The switch is actuated by a trigger. A passive check valve member normally closes a passageway preventing fluid flow from the container into the body. The check valve member is displaceable to permit air flow into the container.

U.S. Pat. No. 5,716,007 discloses a battery operated, hand-held fluid dispenser. The dispenser includes a supply container, a pump and discharge unit, and a discharge nozzle. The pump includes a removable battery powered pump drive unit.

U.S. Patent Publication No. 06/0289679 discloses an interchangeable liquid sprayer that is removably attached to a liquid reservoir. The sprayer includes a discharge nozzle, a manually or electrically powered pump and an actuation mechanism for the pump. The sprayer also includes a quick-release coupling means for attaching the sprayer to a complementary quick-release coupling means fitted to the product reservoir.

Many sprayers are portable home and garden sprayers. Such sprayers are known to include a tank and a manual pumping device threadedly secured to the top of the tank. Such sprayers include "backpack" sprayers that are hand carried or supported by one shoulder strap or on the back in a backpack manner. These sprayers are usually provided with a pump that dispenses liquid from a relatively small volume container and forces the liquid through a manually controlled wand.

U.S. Pat. No. 5,752,661 discloses a backpack sprayer for spraying liquids. The sprayer includes an on board battery that drives a motor/pump assembly for pumping liquid through a manually controlled wand for spraying.

U.S. Pat. No. 4,651,903 discloses a sprayer apparatus having a molded container with a back support panel that is intended for use in abutting relation with the back of a user. The apparatus includes a centrally disposed pressure vessel within the container. The pressure vessel includes a check valve for liquids that enter the vessel. The pressure vessel communicates with a motor operated pump. The motor operated pump replaces a conventional manual pump to pressurize the vessel and direct liquid from the container to a sprayer.

U.S. Pat. No. 5,671,884 discloses an improved backpack sprayer. The sprayer includes a supply tank, an expandable accumulator, a pump mechanism, an intake valve, a discharge valve, and a spray wand with a nozzle. The pump mechanism is positioned adjacent to the bottom of the tank. The pump mechanism pumps fluid from the supply tank to the accumulator. The intake valve enables unidirectional flow from the pump to the accumulator. Fluid is discharged through the discharge valve into the spray wand and nozzle.

A key problem with conventional home and garden sprayers is that the manual pumping device requires the user to manually pump air into the tank to build-up sufficient air pressure within the air space above the liquid to be dispensed. Typically, these manual pumping devices require numerous manual pumping strokes to spray the liquids for just a few seconds. Additional manual pumping is required to re-pressurize the tank for further spraying. The pumping and spraying procedure is continued until the spraying operation is completed. It is evident that this procedure is physically exhausting for the user, is difficult to use, and is very impractical and antiquated.

One approach to solving the problem is elimination of the manual pumping device. U.S. Pat. No. 8,985,482 discloses a pumpless handheld sprayer for use in the lawn and the garden. The sprayer includes a tank with an internal cavity for holding liquids for spraying and a canister that includes pressurized gas. The sprayer also includes a spray wand and a nozzle assembly. The pressurized gas canister communicates with the tank cavity, to pressurize the cavity to force the liquid through the nozzle, assembly and spray wand.

Another approach utilizes a battery-operated pump. U.S. Pat. No. 4,925,105 discloses a rechargeable garden sprayer. The sprayer includes a container, a lower suction tube, and an inlet. The inlet cooperates internally with the main body of the container such that liquid poured in through the inlet flows to the container. The garden sprayer also includes, a power unit including a closed-type battery, a socket, a pump, a switch, and a nozzle tube. The nozzle tube is telescopic.

U.S. Pat. No. 3,993,245 discloses a spraying device that includes a spray tank connected through a spray valve to one or more spray nozzles. The spray tank communicates with a charging valve. The charging valve includes means adapted to provide a substantially fluid-tight seal between a container and the charging valve, container attachment means, and container puncturing means.

U.S. Pat. No. 5,695,121 discloses a self-contained portable sprayer system that includes a tank for receiving a fluid mixture. The system includes a cyclic air pump that forces air into the tank. The system also includes a pressure release valve that is positioned on the top portion of the tank.

U.S. Pat. No. 6,135,361 discloses a garden sprayer for spraying liquids such as pesticides, fertilizers, and herbicides. The garden sprayer includes a housing holding a reservoir, a conduit, and a pump. The conduit includes a free outer end. A spray nozzle is coupled to the free outer end of the conduit. The spray nozzle has a trigger with a switch for selectively actuating the pump.

A disadvantage with many portable home and garden sprayers is the possibility of the user over pressurizing the tank causing the tank to rupture and possibly injuring the user. Consequently, many sprayers include conventional pressure relief devices.

U.S. Pat. No. 5,931,207 discloses a portable home and garden sprayer that includes a tank having a conventional air pressure gauge and a pressure relief valve. The sprayer also includes a hand held compressed air power unit. The hand held compressed air power unit includes a housing and an air compressor that communicates with the tank. The air compressor directs air into the tank to spray continuously until the tank empties.

U.S. Pat. No. 6,145,711 discloses a portable sprayer having a tank, a head portion, and a pump unit. The pump unit is powered by a motor to pressurize the tank. The pump unit includes a switch that is actuated when the tank pressure gets below a certain threshold to activate the motor. The sprayer also includes a pressure relief device.

U.S. Pat. No. 6,109,548 discloses a sprayer system that has a reservoir, a manual pump, an electric motor, a battery, and an air compressor. The electric motor and the compressor are mounted within an indentation of the reservoir. The electric motor operates the air compressor whenever the air pressure within the reservoir drops below a predetermined level when a pressure switch is closed. When the air pressure within the reservoir rises above a predetermined level, the electric motor is deactivated thereby preventing the reservoir from becoming over-pressurized. The manual pump may be utilized when the electric pump fails or the battery becomes discharged.

U.S. Pat. No. 8,985,482 discloses a pressurized sprayer tank holding a quantity of liquid and having an opening to facilitate connection to a feed line for supplying a spray nozzle. An electric pump module is releasably connected to the tank through a connector and the pump module comprises an electric pump, a switch assembly, and a check valve, wherein the electric pump module directs gas through a check valve into the connector to increase the gas pressure in said tank. The liquid in the tank is forced to flow through the feed line and out of the spray nozzle. The switch assembly turns off the electric pump when the gas pressure in said tank exceeds a predetermined limit while maintaining the flow of liquid through the spray nozzle.

U.S. Pat. No. 8,672,364 discloses a quick disconnect device for the portable tank disclosed in U.S. Pat. No. 8,985,482 for releasably connecting a hand held pressurized sprayer tank to a portable pump assembly selected from an electric pump module and a power pack assembly

SUMMARY OF THE INVENTION

In accordance with the present invention there is provided a portable pressurized sprayer. A tank holds a quantity of liquid and has an opening to facilitate connection to a feed line for supplying a spray nozzle. A portable pump assembly releasably connects to the tank through a connector and has an electric pump, a switch assembly, and a check valve. The portable pump assembly directs gas through the check valve into the connector to increase the gas pressure in the tank and forces the liquid in the tank to flow through the feed line and out the spray nozzle. The switch assembly turns off the electric pump when the gas pressure in the tank exceeds a predetermined limit while maintaining the flow of liquid through the spray nozzle.

Further in accordance with the present invention, there is provided a portable pump assembly for injecting gas into a sprayer tank. A housing for releasable connection to the sprayer tank is provided. Valve means are positioned within said housing for conveying gas to the sprayer tank. Pumping means are positioned within the housing for directing gas through the valve means to pressurize the sprayer tank. Switching means are positioned within the housing for actuating the pumping means and for monitoring the gas pressure of the sprayer tank. A power supply is positioned within said housing for supplying power to the pumping means.

Further in accordance with the present invention, there is provided a method for spraying liquid. A housing is releasably connected to a quick disconnect connector on a tank that holds a quantity of liquid for spraying. An electric pump positioned within the housing is actuated to pump gas through a check valve through the quick disconnect connector into the tank to force the liquid through a nozzle. The pressure within the tank is monitored to determine when the pressure exceeds a predetermined limit. The pump is switched off after the pressure exceeds the predetermined limit.

Further in accordance with the present invention, there is provided a new and improved quick disconnect device for connecting a tank to a portable pump assembly. A tubular body has an internal passageway for conveying gas between the tank and the portable pump assembly. A new and improved pump assembly can be securely fastened to the tank in a more time saving and secure manner. Accordingly, a principal object of the present invention is to provide a portable pressurized sprayer that includes a releasably connected portable pump assembly.

Another object of the present invention is to provide a sprayer that utilizes a quick disconnect connector with an integrated pressure relief valve to connect to a portable pump assembly.

Another object of the present invention is to provide a portable pressurized sprayer that includes a portable pump assembly with a mechanism that shuts off the pump when the internal pressure of the sprayer exceeds a predetermined limit.

A further object of the present invention is to provide a method for spraying that utilizes a modular pump assembly that includes a quick disconnect connector with an integrated pressure relief valve.

Another object of the present invention is to provide a portable pressurized sprayer that includes a portable pump assembly that pumps gas into a tank to facilitate spraying of liquid from the tank.

Another object of the present invention is to provide a backpack system wherein the portable pressurized sprayer can be placed into the backpack system allowing the tank to be supported on a human carrier's back.

These and other objects of the present invention will be more completely described and disclosed in the following specification, accompanying drawings, and appended claims.

DESCRIPTION OF THE PREFERRED EMBODIMENTS

Figure 1:
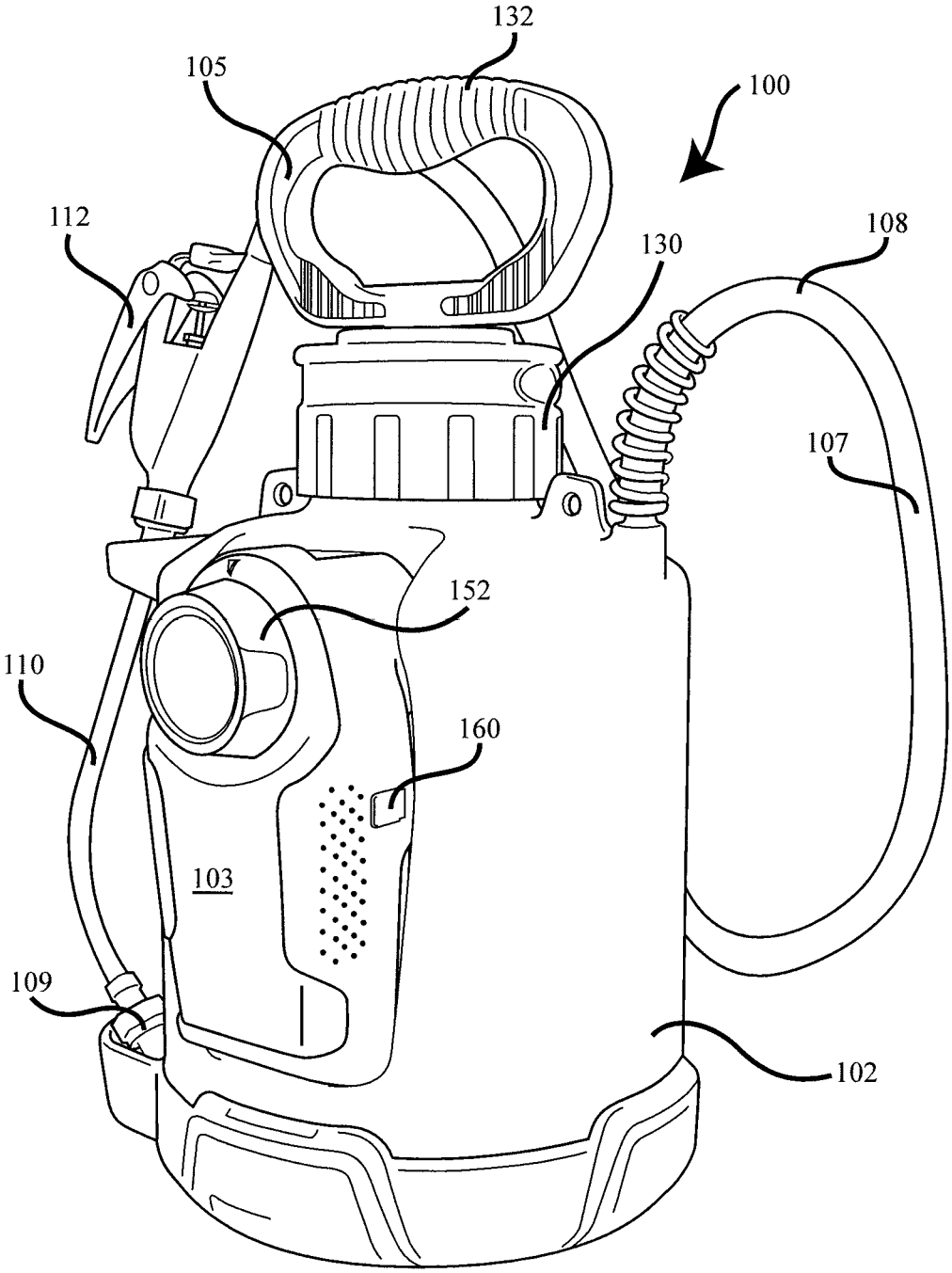
FIG. 1 is an isometric view of a portable pressurized sprayer, illustrating a detachable, portable pump assembly releasably connected to a tank.

Referring to the drawings and, particularly, to FIG. 1, there is illustrated a portable pressurized sprayer 100, particularly adapted for spraying liquids from a tank 102. The tank 102 serves as a reservoir for storing various liquids to allow the portable pressurized sprayer 100 to function as a multi-purpose sprayer. The portable pressurized sprayer 100 includes both a portable pump assembly 103 which is in fluid communication with the tank 102 and a manual pump 105 that is threadedly connected to the tank 102. The portable pump assembly 103 can function as an electric pump module or a power pack assembly.

Figure 2:
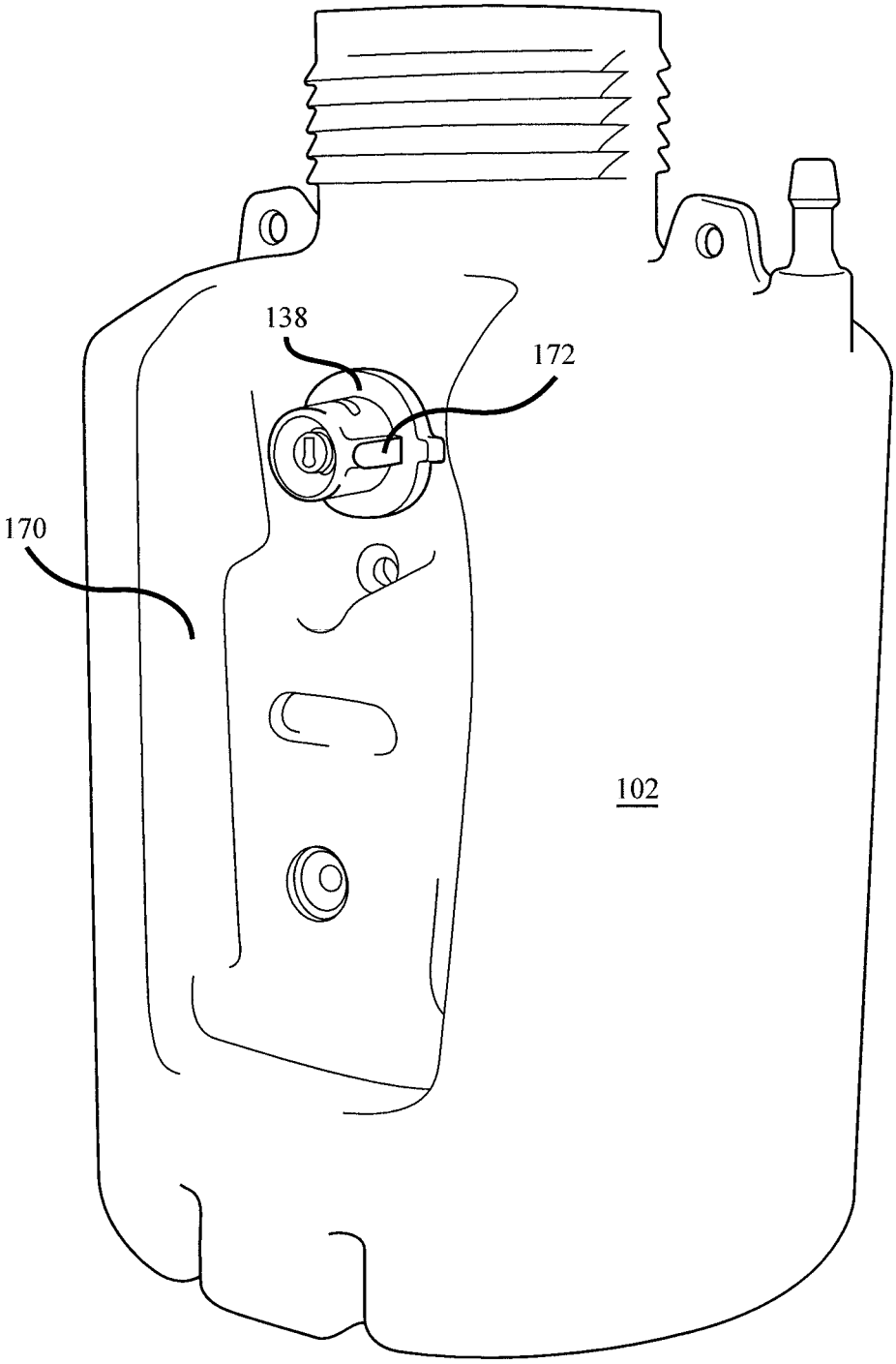
FIG. 2 is an isometric view of the tank shown in FIG. 1, illustrating the tank without a portable power pump assembly attached.

The portable pressurized sprayer 100 includes the tank 102, the portable pump assembly 103, the manual pump 105, a feed mechanism 107, and a spray nozzle 109. The portable pump assembly 103 is a self-contained, separately assembled module or unit that transports gas to the tank 102 through a connector 138 as shown in FIG. 2, that extends outwardly from the wall of the tank 102. The connector 138 releasably connects the portable pump assembly 103 to the tank 102 without transferring liquids from the interior of the tank 102 to the portable pump assembly 103. Preferably, the portable pump assembly 103 pumps air through the connector 138.

The tank 102 holds a selected quantity of liquid. The portable pump assembly 103 directs air through the connector 138 into the tank 102 to increase the air pressure in the tank 102 to force the liquid to flow through the feed mechanism 107 and out of the spray nozzle 109. The portable pump assembly 103 compresses the air within the interior of the tank 102 without compressing the liquid contained therein.

The portable pump assembly 103 maintains the flow of liquid through the spray nozzle 109 and has the ability to stop pumping air into the tank 102 when the air pressure in the tank 102 exceeds a predetermined limit. The ability of the portable pump assembly 103 to shut off the flow of air to the tank 102 enhances the safety of the portable pressurized sprayer 100. This function also conserves energy and increases the life of the individual components of the portable pressurized sprayer.

As shown in FIG. 2, the connector 138 transports air into and out of the tank 102.

Figure 5:
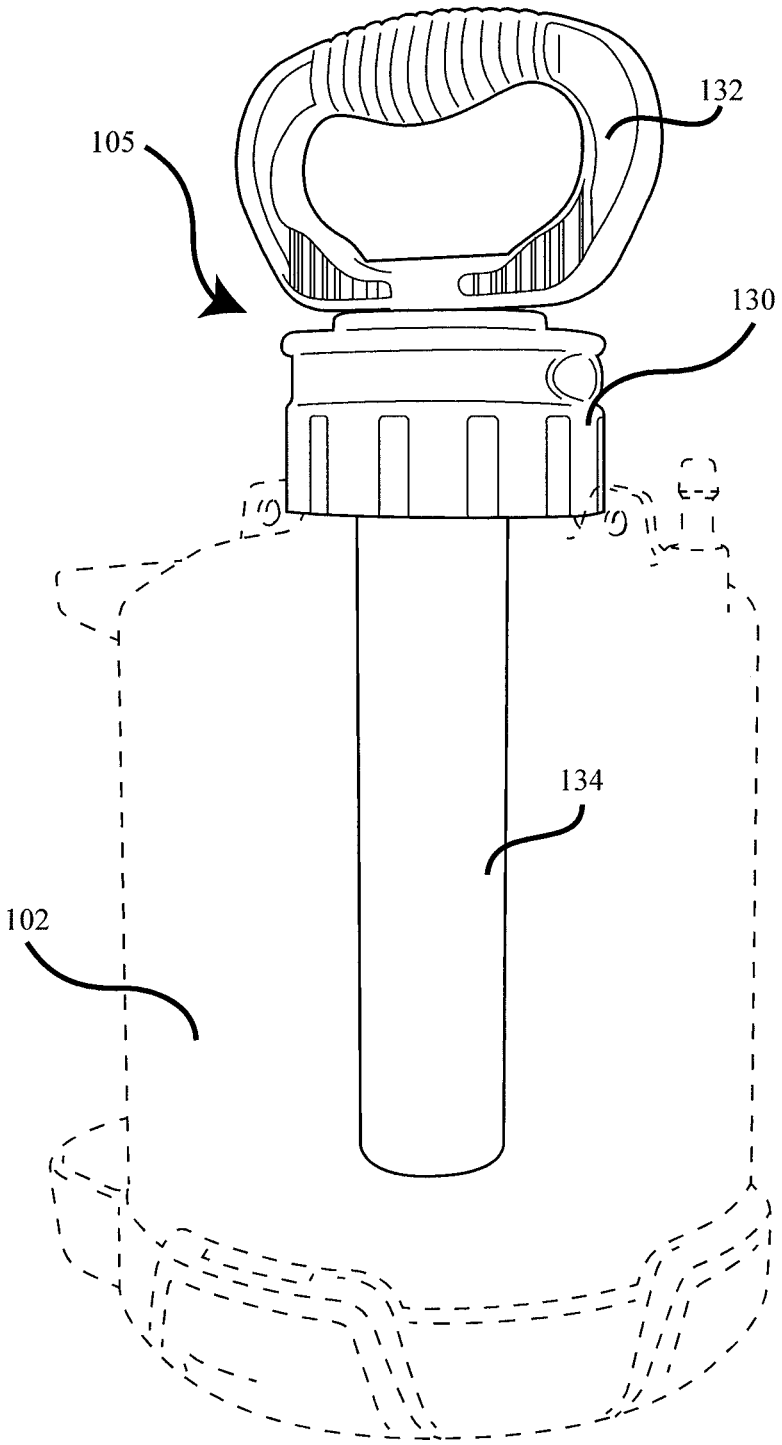
FIG. 5 is an isometric view of the manual pump in a broken line view of the tank.

As shown in FIG. 5, the manual pump 105 includes a screw cap 130, a handle 132, and a shaft 134. The screw cap 130 is threadedly connected to the top of the tank 102. The shaft 134 extends through the cap to allow the manual pump 105 to communicate with the interior of the tank 102. The handle is positioned on the top of the shaft 134.

Liquid is discharged from the tank 102 by operation of the manual pump 105 to inject air into the tank 102, forcing the liquid to flow through the feed mechanism 107 and out of the spray nozzle 109. The manual pump 105 is utilized primarily when the portable pump assembly 103 is inoperable or disconnected from the tank 102. As shown in FIGS. 1 and 5, the manual pump handle 132 is also utilized to facilitate carrying of the portable pressurized sprayer 100. Alternatively, the portable pressurized sprayer 100 may include a strap (not shown) to facilitate carrying.

As shown in FIG. 1, the feed mechanism 107 connects the tank 102 and the spray nozzle 109 to facilitate transfer of liquids from the tank 102 for spraying. The feed mechanism 107 includes a flexible feed line 108, a spray wand 110, and a spray handle 112. The feed line 108 is in fluid communication with the tank 102.

Figure 3:
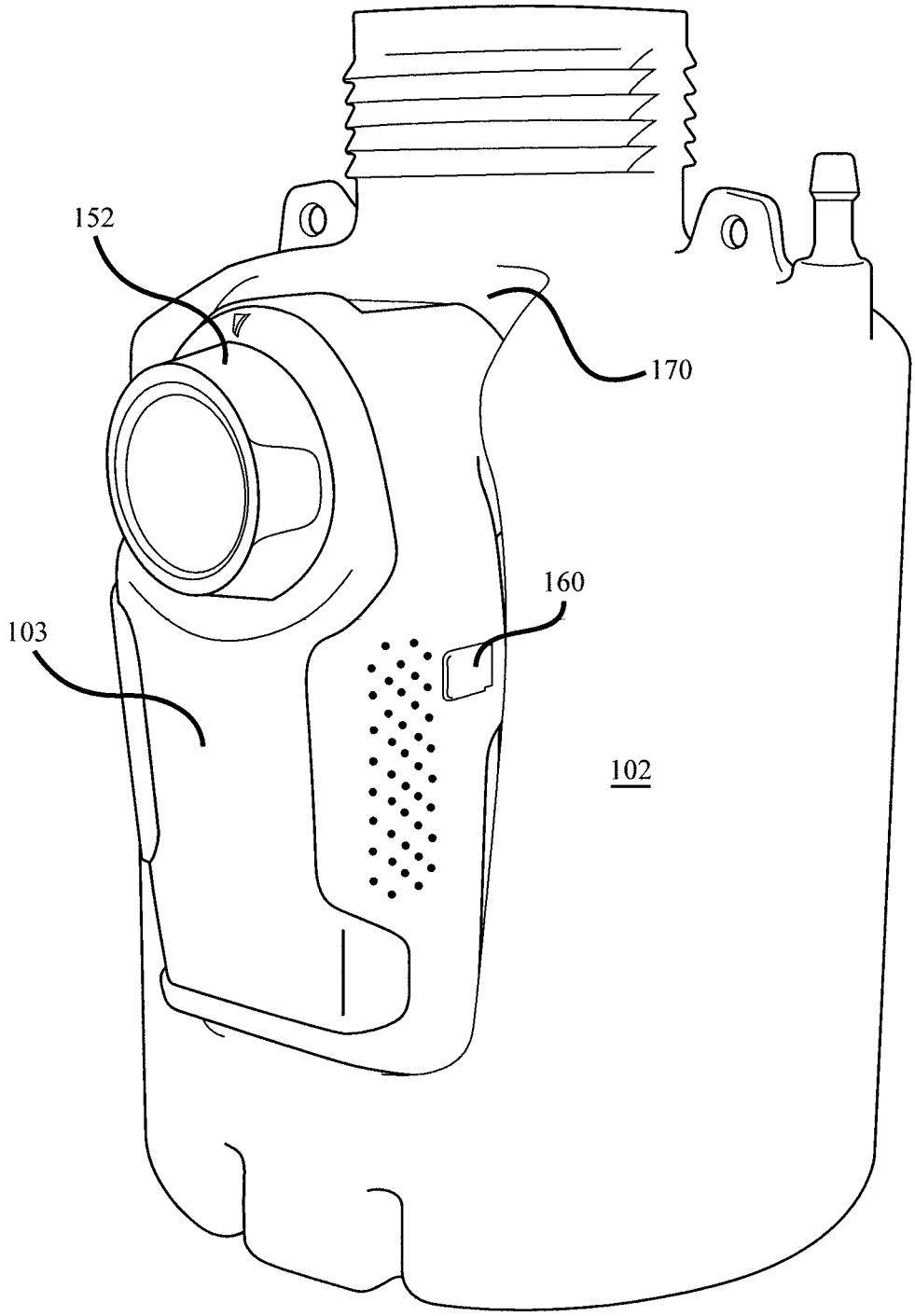
FIG. 3 is an isometric view of the tank with portable power pump connected.

The tank 102, the portable pump assembly 103, the manual pump 105, the feed mechanism 107, and the spray nozzle 109 are made from any suitable materials through any suitable manufacturing process. Preferably, the tank 102 is made from a plastic material, preferably polyethylene. The side of the tank 102 comprises a recess 170 to receive the pump assembly as shown in FIG. 2. As shown in FIG. 3, once the portable pump assembly 103 is inserted into the recess 170 of the tank 102, the portable pump assembly 103 is securely fixed to the tank 102.

As shown in FIGS. 6-9, the portable pump assembly 103 is connected to the tank 102 by aligning the connector 138 with a connecting mechanism 150 integrally enclosed within the portable pump assembly 103. The connecting mechanism 150 inserts into connector 138 to actuate the flexible fingers 146 to releasably connect the portable pump assembly 103 to the tank 102.

Figure 4A:
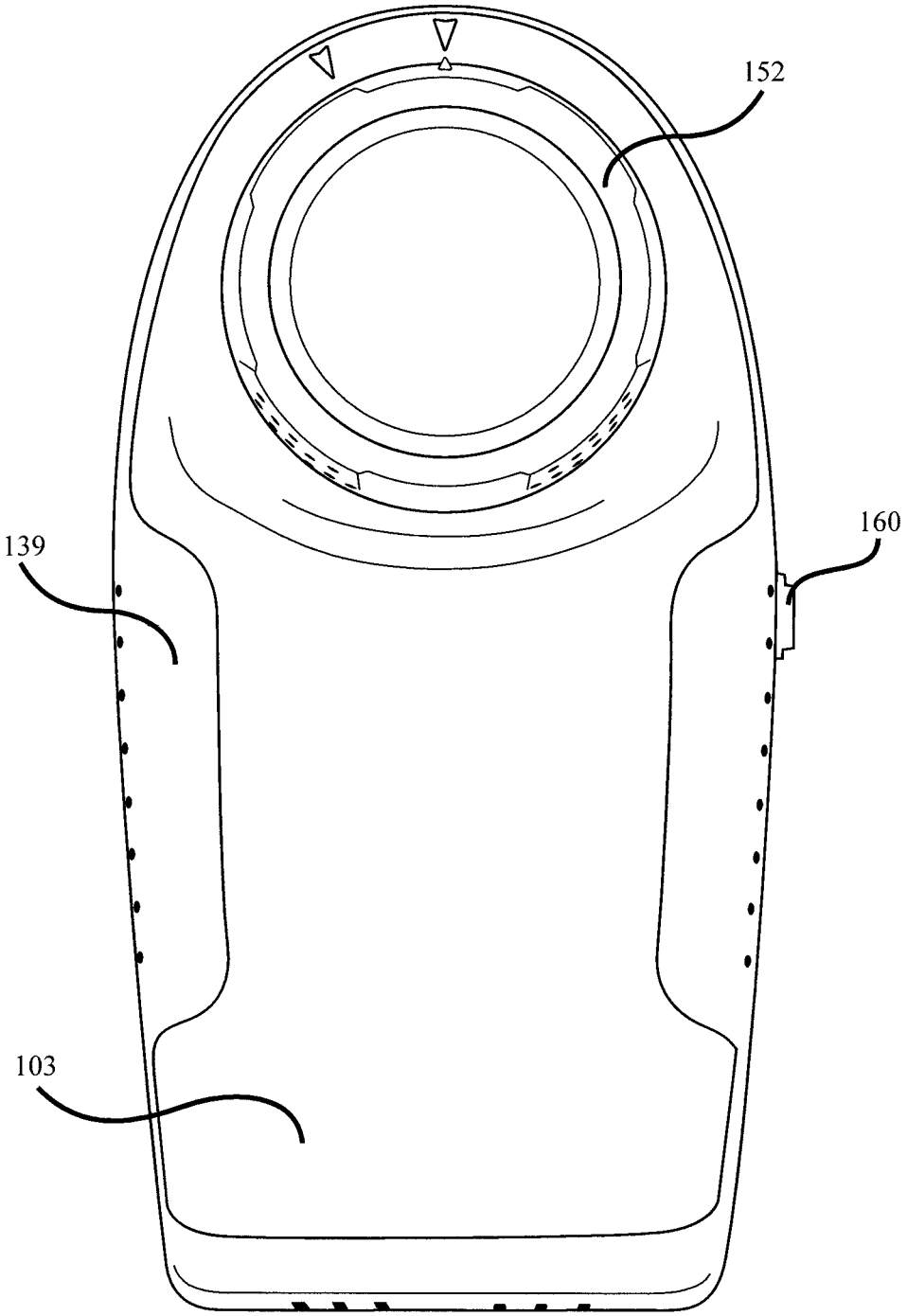
FIG. 4A is a front view of the portable power pump without the manual pumping means or connector.
Figure 4B:
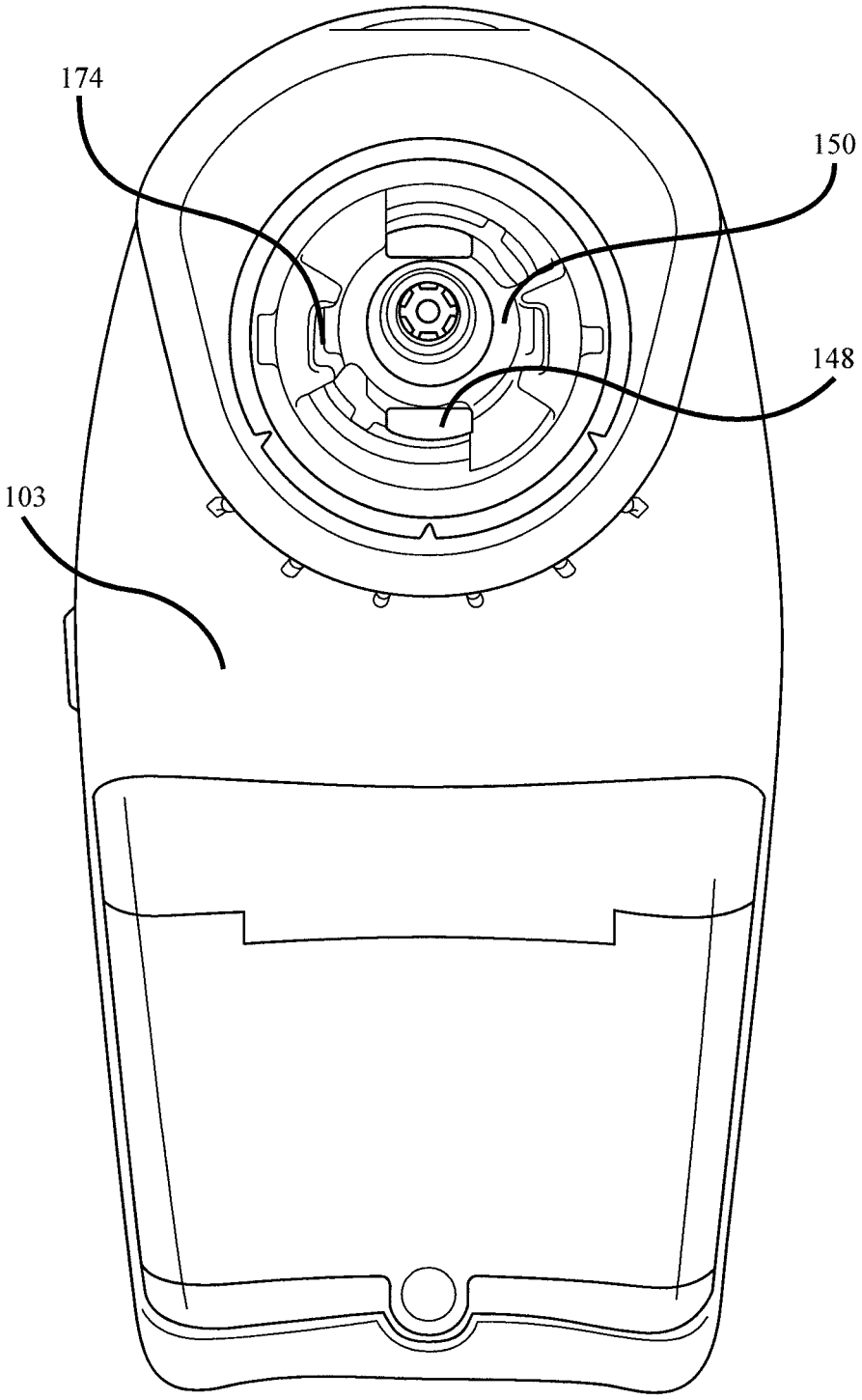
FIG. 4B is a rear view of the portable power pump.
Figure 4C:
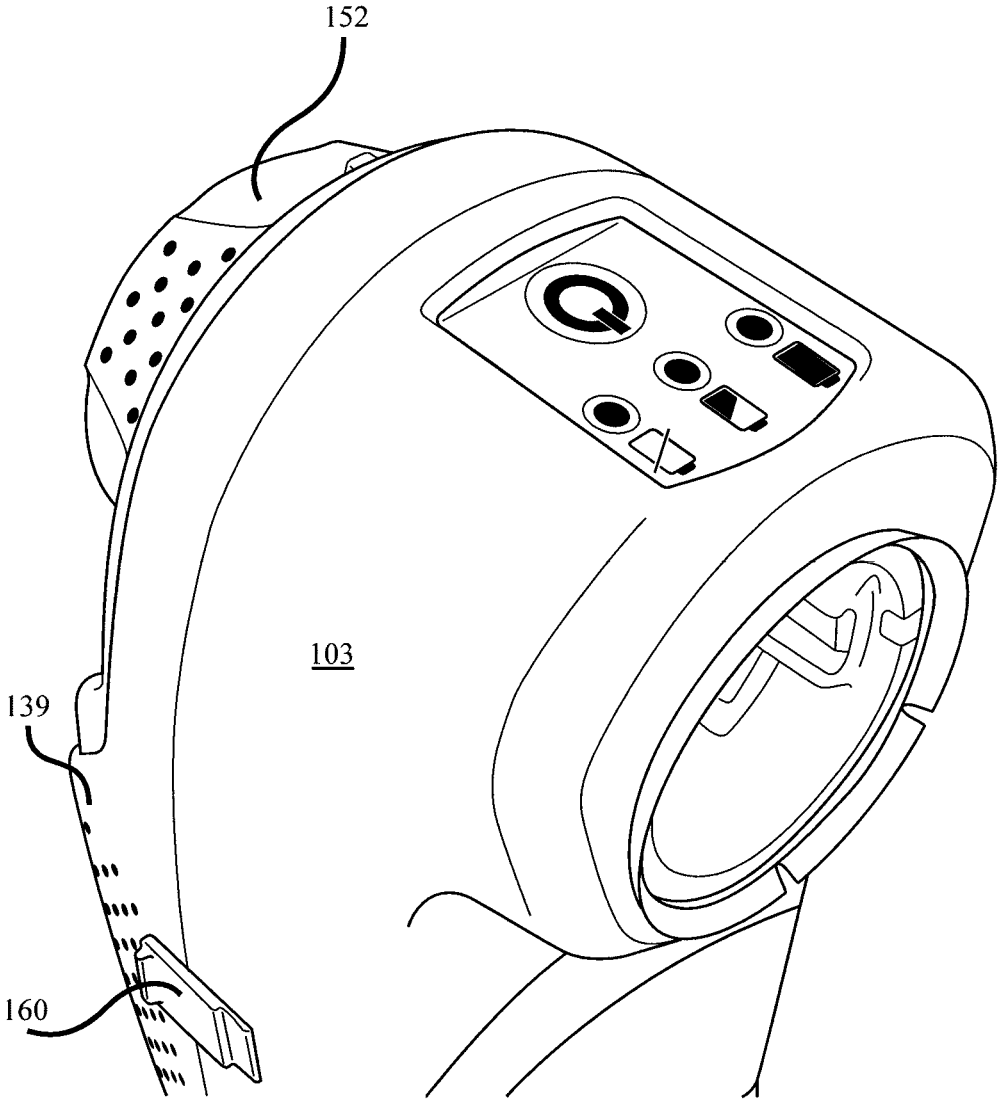
FIG. 4C is a top perspective view of the portable power pump.
Figure 4D:
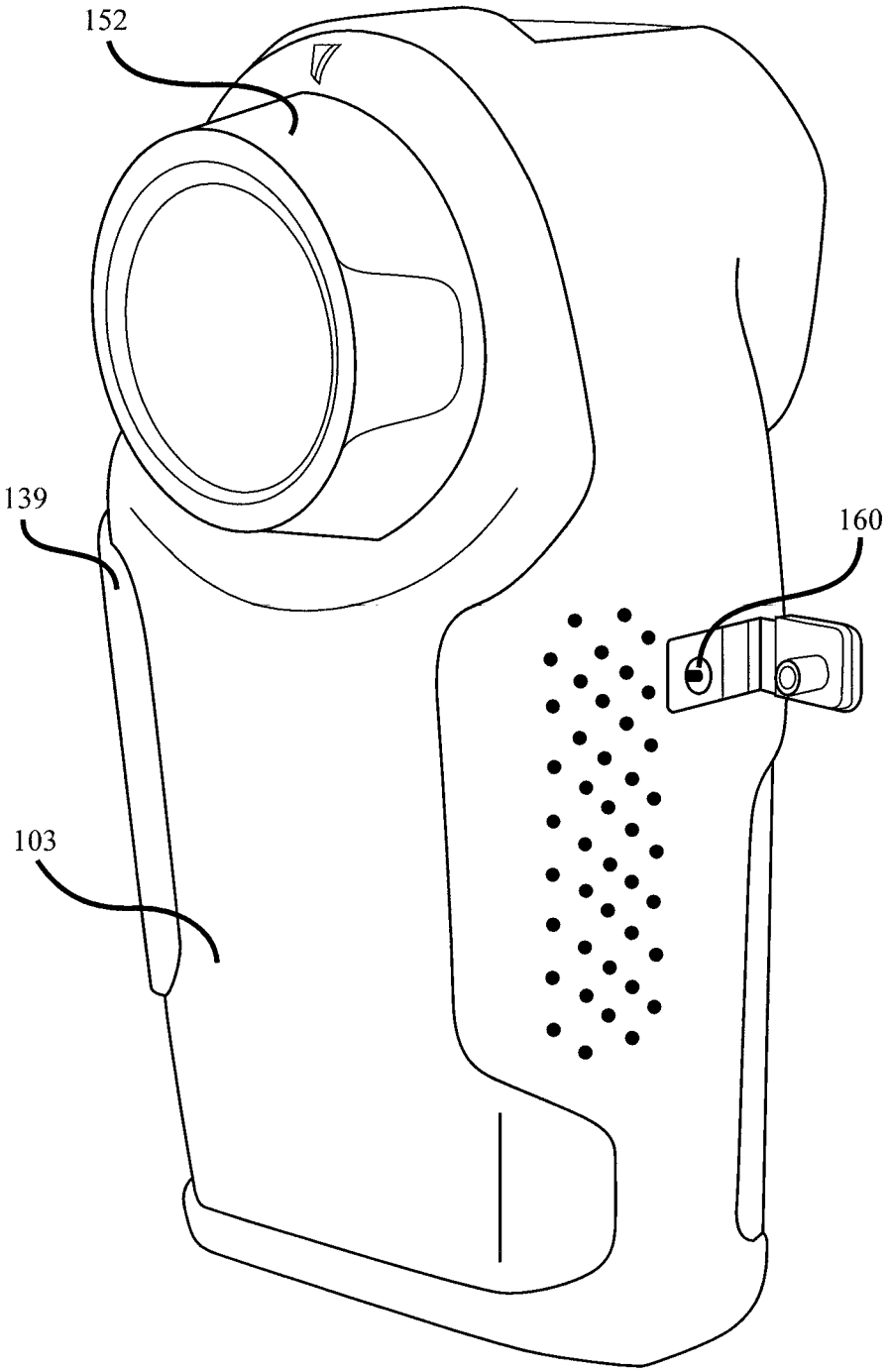
FIG. 4D is a right side perspective view of the portable power pump.
Figure 9:
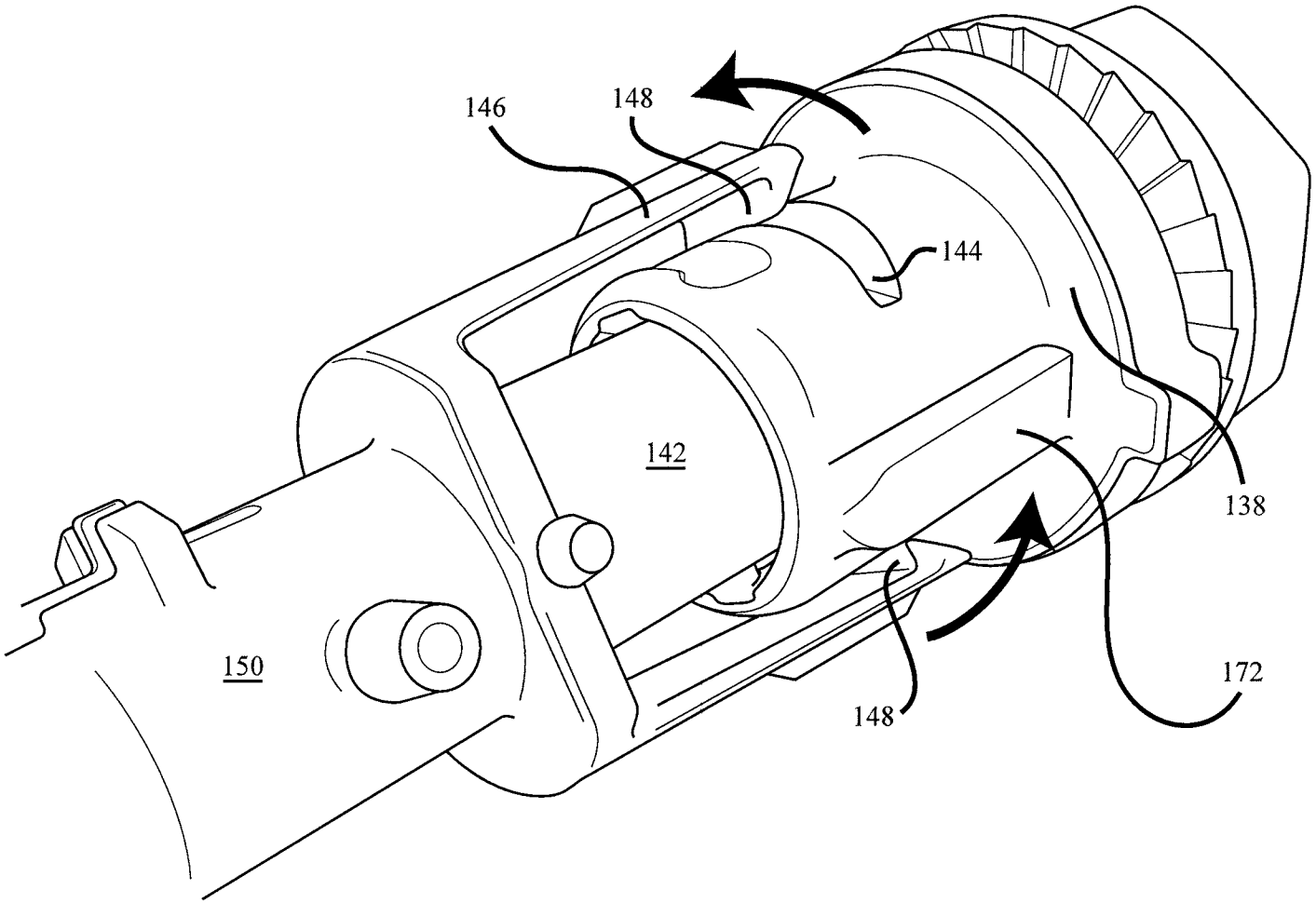
FIG. 9 is an isometric view of the connection means between the connector and connection mechanism showing rotation of the connection mechanism.

As shown in FIGS. 6-9, the portable pump assembly 103 housing connects to the connector by sliding the portable pump assembly 103 housing over the connector body until the shaft lock-lever nibs 148 of the connecting mechanism 150 attached to the flexible fingers 146 engage the slots 144 on the outside of the connector 138. The portable pump assembly 103 housing is prevented from rotating about the connector body by the two raised keys 172 on the connector 138 which engages two slots in the housing 174, shown in FIG. 4B, of the portable pump assembly 103. When the portable pump assembly housing is pushed onto the connector 138, the shaft lock-lever finger nibs 148 slide over the connector 138 and slide down into the slots 144 on the connector 138, locking the portable pump assembly 103 housing to the connector 138. The shaft lock-lever 142 internal diameter also slides over the connector pin 176 and seals to the O-ring on the pin to form a seal with the shaft lock-lever 142. As shown in FIG. 9, disconnection of the shaft lock-lever 142 and thus the portable pump assembly 103 from the connector 138 occurs when the dialing mechanism 152 attached to the shaft lever-lock 142 is rotated, preferably counter-clockwise, causing the shaft lock-lever nibs 148 to slide sideways out of the slots on the connector 138 allowing the portable pump assembly 103 to be removed from the connector 138. With the new connector 138 and connecting mechanism 150 of the present invention, the portable pump assembly 103, is pushed into recess 170 of the tank 102 and to rotate the portable pump assembly 103.

Figure 11:
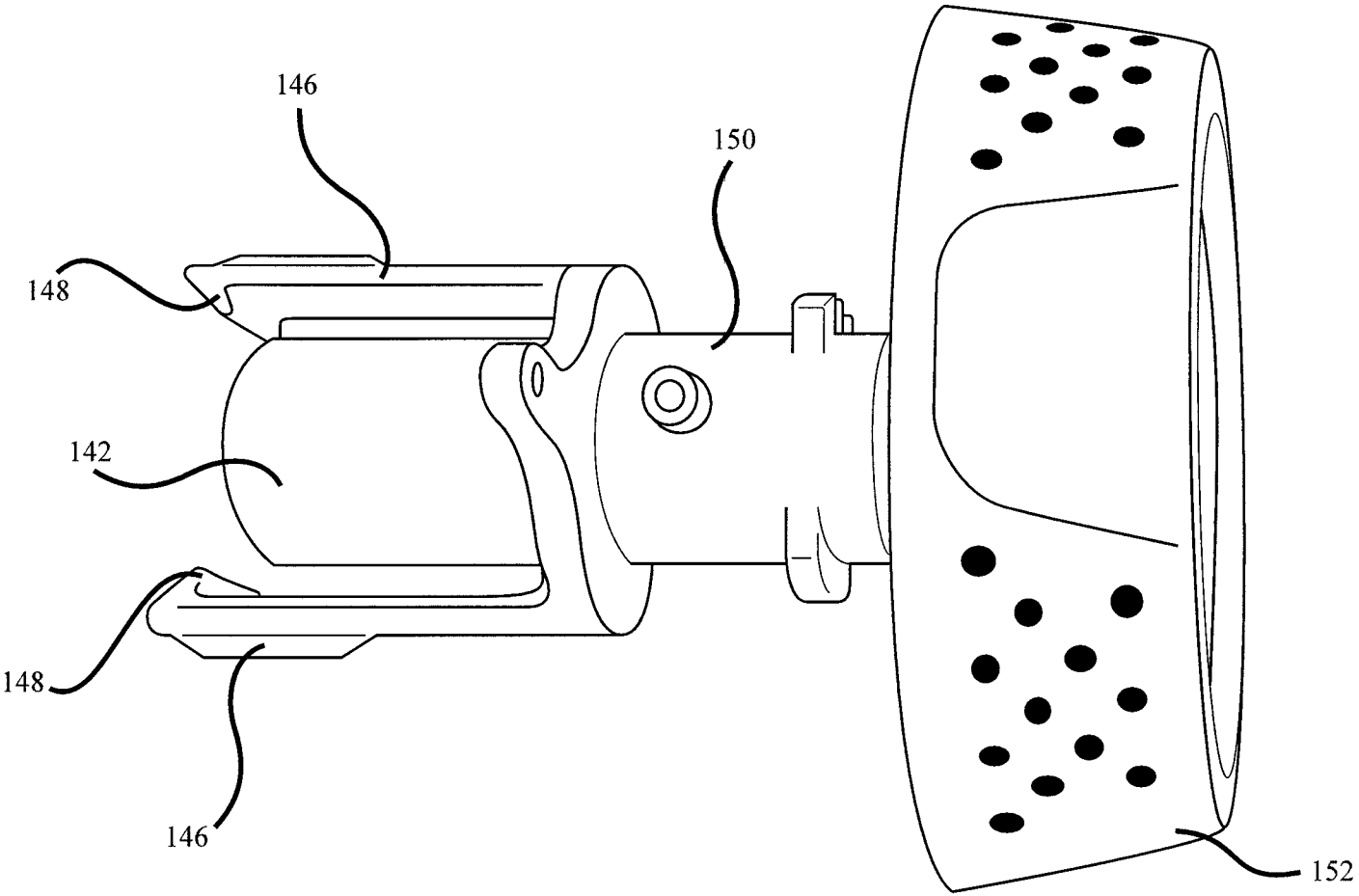
FIG. 11 is an isometric view of the connection mechanism and the dialing mechanism.

The connecting mechanism 150 is releasably connected to a dialing mechanism 152 as shown in FIG. 11, which is located on the outward facing side (away from the tank 102) wherein the dialing mechanism 152 is rotated to turn the connecting mechanism 150 such that the first and second nibs 148 are turned and no longer fitted into the slots 144. The portable pump assembly 103 can then be removed from the tank 102 by simply pulling and removing the portable pump assembly 103 from the tank 102.

The portable pump assembly 103 is pressed into the recess 170 area of the portable tank wherein the connecting mechanism 150 as shown in FIG. 9 is releasably connected with the connector 138. As a result, the portable pump assembly 103 is fit into the recess 170 of the tank and becomes more secure than the presently known spray tank assemblies by being less inclined to be knocked off or broken off from the tank as shown in FIG. 3.

Figure 6:
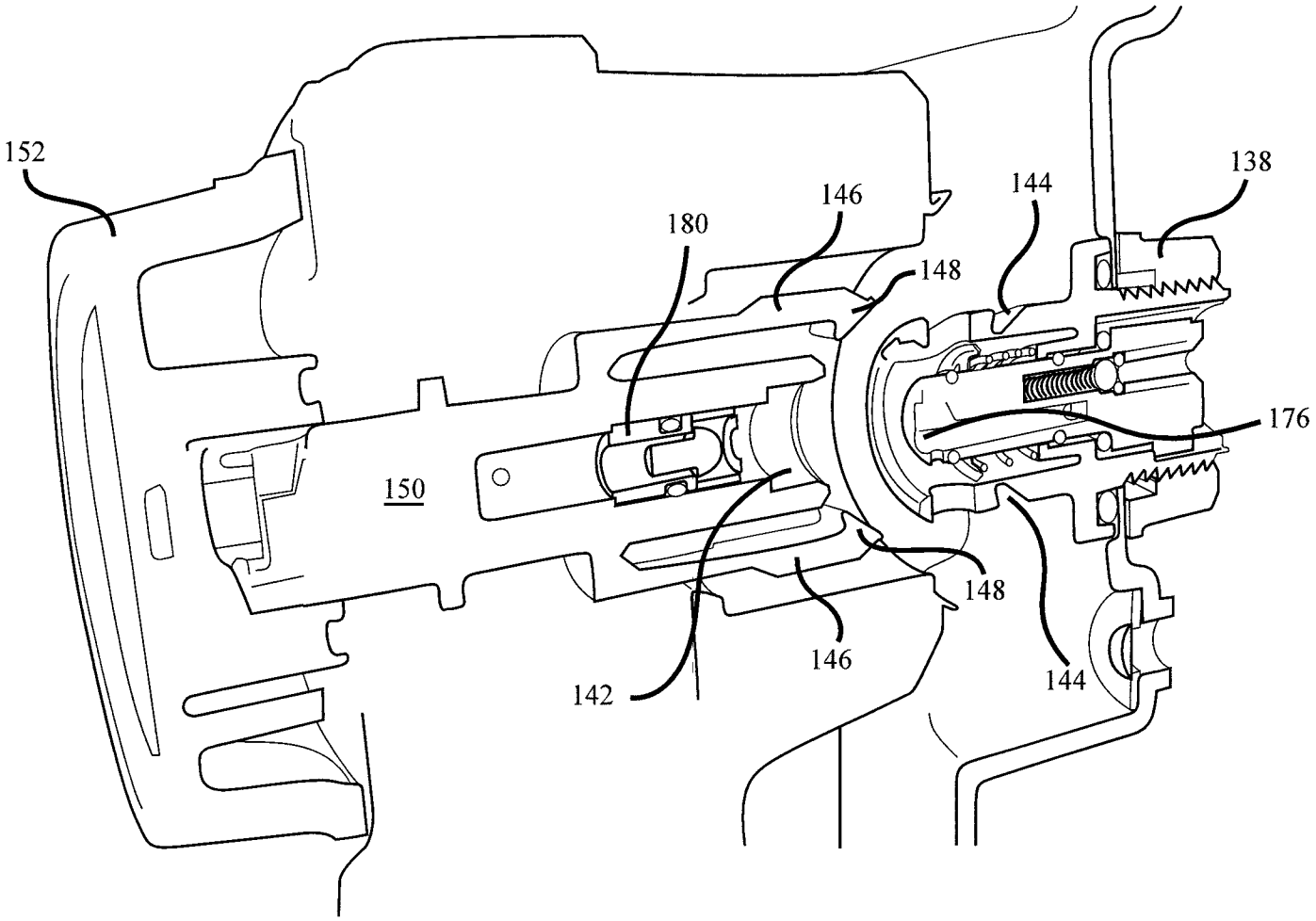
FIG. 6 is a cross-sectional view of the connector and the connecting mechanism partially engaged.
Figure 7:
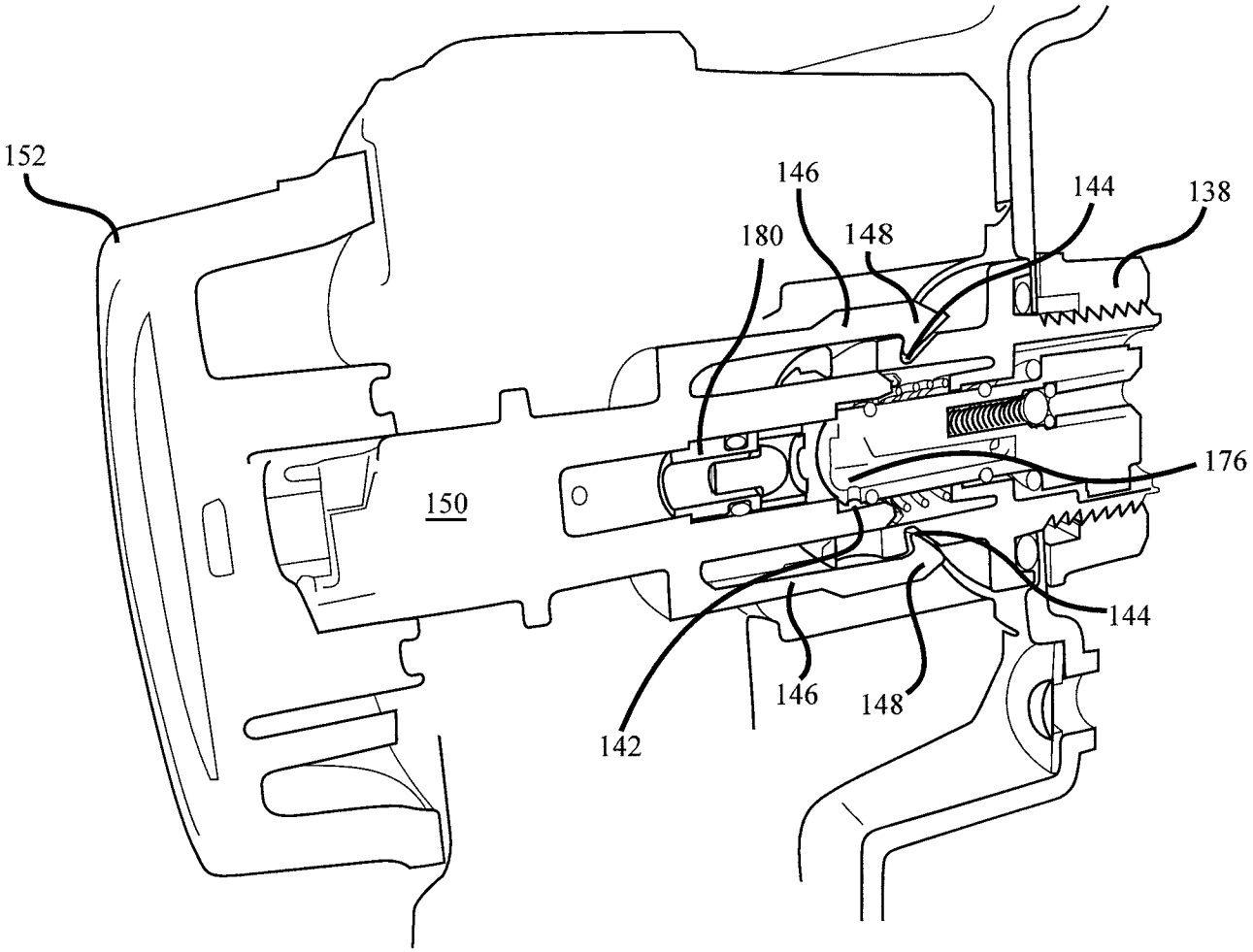
FIG. 7 is a cross-sectional view of the connector and the connecting mechanism fully engaged.
Figure 8:
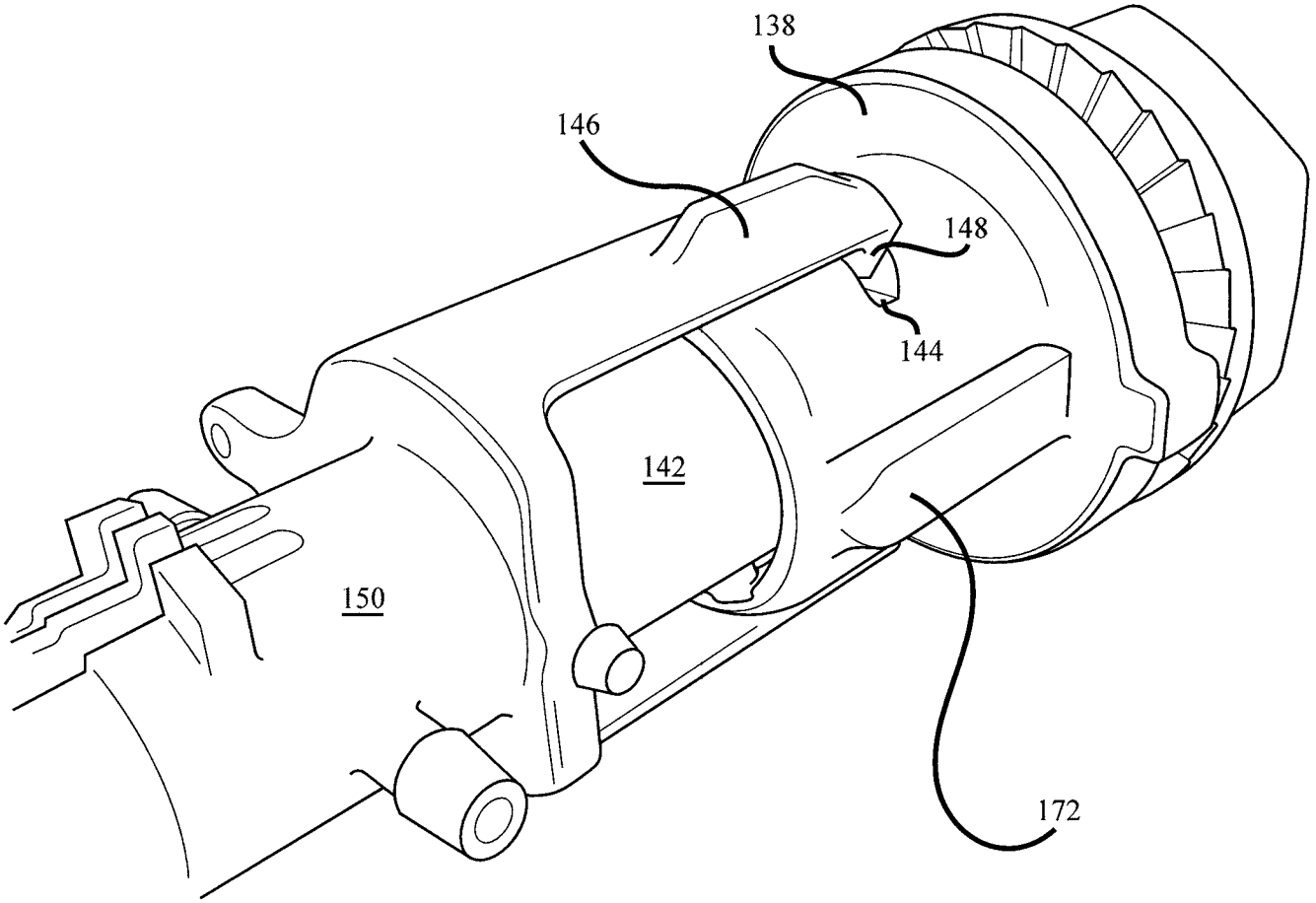
FIG. 8 is an isometric view of the connection means between the connector and connection mechanism.

Referring now to FIGS. 4A-D and 10, the portable pump assembly 103 is a lightweight unit that includes a housing 139 for holding an internal pump mechanism. The pump mechanism includes an electric air pump 121, a switch assembly 123, a power supply 125, and a valve assembly inside the connecting mechanism 150. In one embodiment, the valve assembly is a check valve 180 as shown in FIGS. 6-7.

The air pump 121 is electrically coupled to the switch assembly 123 and the power supply 125. The power supply 125 provides power to the electric air pump 121 until the switch assembly 123 turns off the air pump 121.

The switch assembly 123 includes an air pressure switch 129 and an on/off switch 131. The air pressure switch 129 incorporates a pressure sensor and a microprocessor 162 to control and monitor the pressure in the tank 102. It prevents the internal pressure of the tank 102 from exceeding a predetermined limit, so that the internal pressure never reaches an unsafe level.

The air pressure switch 129 is operable such that it can actuate the electric air pump 121. The air pressure switch 129 shuts off the electric air pump 121 when the internal pressure in the tank 102 shown in FIGS. 1 and 2 reaches a predetermined limit. In this manner, the life of the power supply 125 and the electric air pump 121 is extended.

The on/off switch 131 actuates the portable pump assembly. The on/off switch 131 can be a conventional on/off switch that allows a user to turn on or to manually shut off the portable pump assembly.

The electric pump connects to the check valve 180 through tubing 182 to transport pressurized air to the tank 102. Tubing 182 connects the check valve 180 to the air pressure switch 129. The air pressure switch 129 transports the pressurized air through a nipple into tubing 182. Tubing 182 extends through an opening in the housing to transport air through the portable pump assembly 103 and into the tank 102, as shown in the embodiment illustrated in FIG. 1.

The power supply is a conventional portable power supply device for operating the portable pump assembly 103 in environments in which access to electrical power sources is limited. The power supply includes a compartment that holds a device for storing power. The compartment includes a door that allows access to the power storing device through the housing.

The portable pump assembly 103 may also include a rechargeable battery pack 148 positioned within a housing.

The portable pump assembly 103 may also include a port 160 to facilitate recharging. The portable pump assembly 103 connects to a plug that is connected to a transformer through a cable. The transformer inserts into a wall outlet, so that the wall outlet transmits power to the power storing device or rechargeable battery pack 148 within the housing 139. The portable pump assembly 103 may also comprise a port 160 to facilitate the external discharge of power from the portable pump assembly 103 to power external devices.

Figure 10:
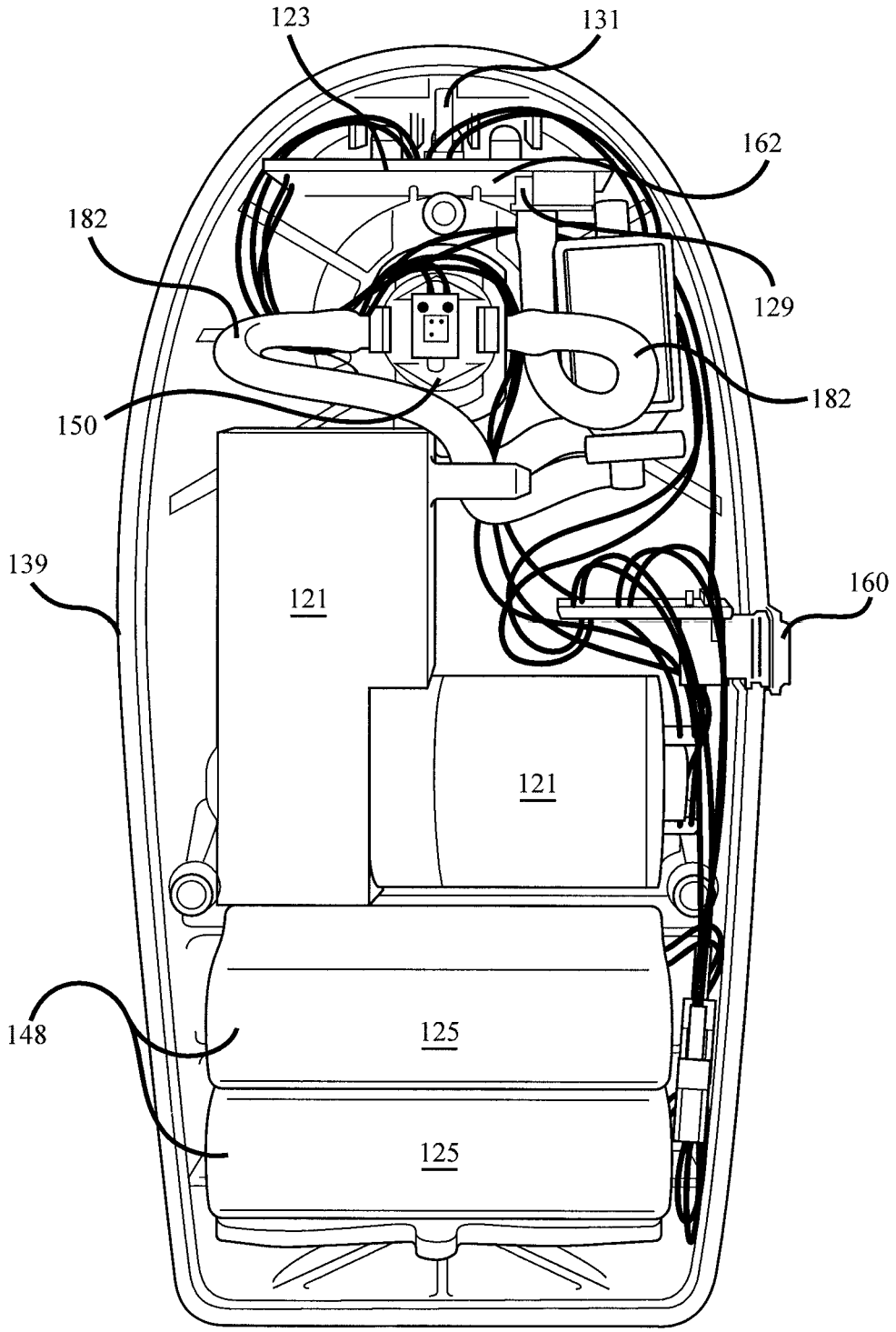
FIG. 10 is an internal view of the portable pump assembly.

As shown in FIG. 10, the portable pump assembly 103 includes an upper half and a lower half that are releasably connected to one another through a conventional connecting device. The two halves can be separated from one another to provide access to the rechargeable battery pack 148 and to the other internal components of the portable pump assembly 103. The portable pump assembly 103 shown in FIG. 10, includes the connecting mechanism 150, as well as the dialing mechanism 152, as shown in FIG. 11.

Another embodiment of a tank 102 is wherein the tank 102 includes a recess 170 in the tank wall for receiving the connector 138. Preferably, the connector 138 is positioned within the recess 170 so that an outer edge of the connector 138 does not protrude from the periphery of the outer surface of the tank 102. The positioning of the connector 138 within the recess 170 prevents the plunger member 176 from being unintentionally depressed in the event the tank is tipped over and the connector 138 is impacted. This prevents the tank from discharging prematurely.

Figure 12:
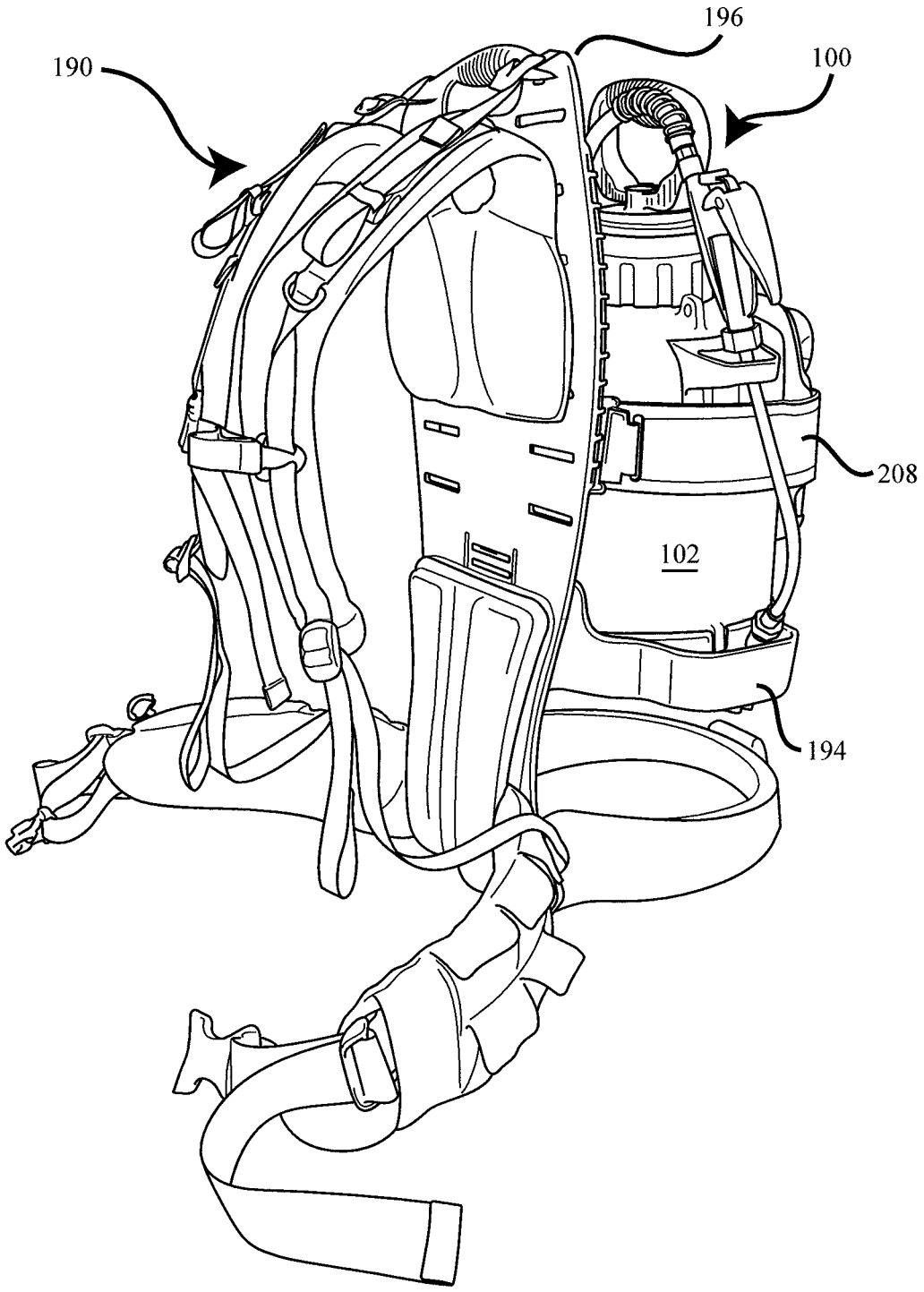
FIG. 12 is an isometric view of the portable pressurized sprayer and the backpack.
Figure 13:
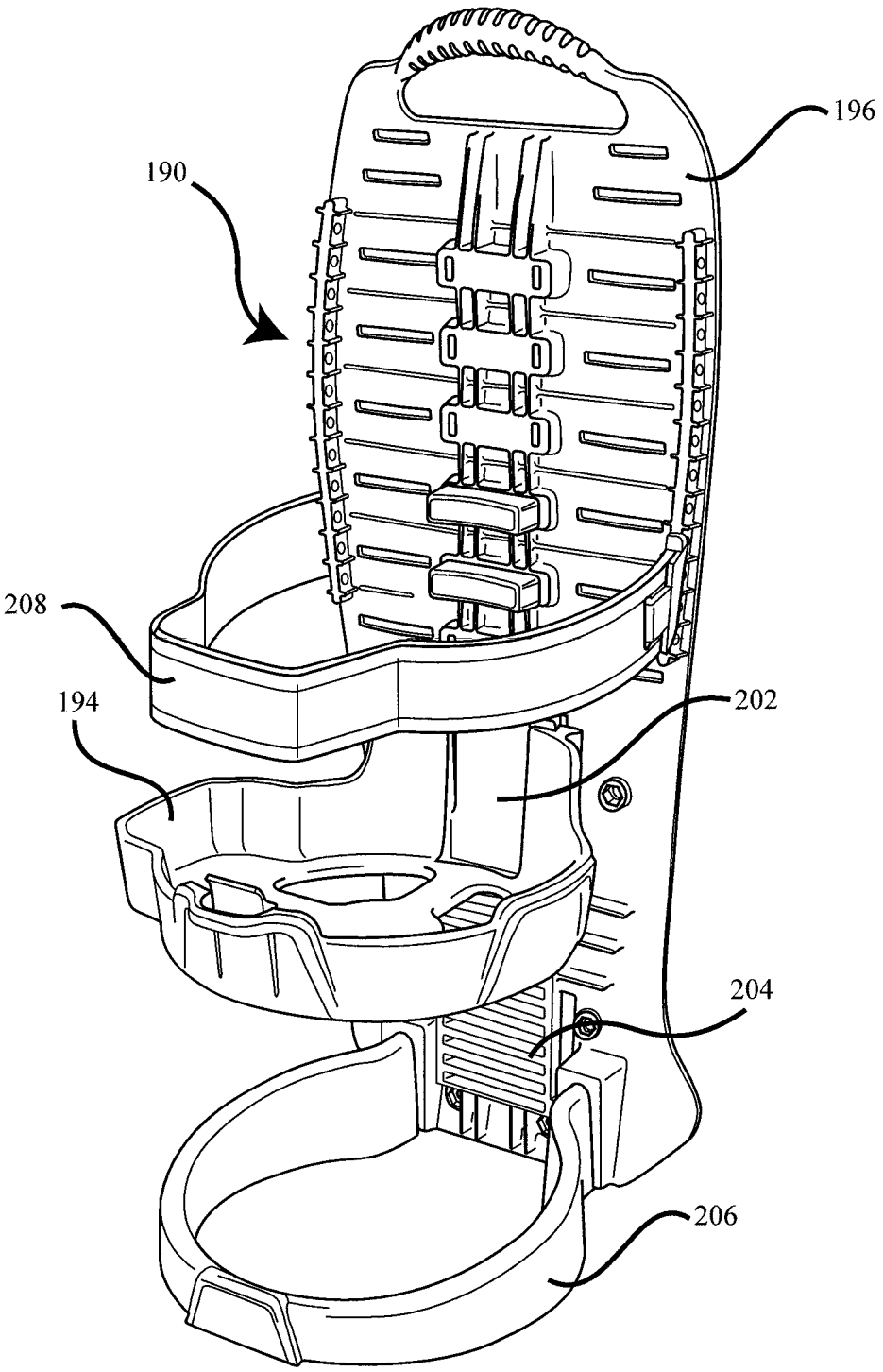
FIG. 13 is an isometric view of the backpack.

As shown in FIGS. 12 and 13, the backpack 190 functions as a support for the tank 102 on a human carrier's back. The backpack 190 is supported on the carrier's back using straps to support the weight mainly at the hips and on the shoulders for improved comfort. The hip and shoulder straps attach to a specially contoured back plate 196 which has a dovetailed slot system for supporting a platen 194. The platen 194 supports the bottom of the tank 102 and holds the tank 102 in place via a lever-lock system 202 designed into the platen 194. The elevation of the platen 194 can be adjusted along the dovetail slide 204 to properly locate the center of gravity of the tank for improved carrying comfort. Once the platen 194 is moved to the proper location, another lever-lock system 202 designed into the platen 194 locks the platen 194 elevation to the back plate 196. The advantage to making the platen 194 easy to be moved is improved comfort based on properly locating the tank center of gravity on the carrier's back. Once the tank 102 is in place on the platen 194 the tank 102 locks the lever mechanism in place such that the platen/tank elevation cannot be changed for safety during backpack 190 usage. The tank 102 is secured to the back plate 196 with a band 208 which is releasably connected to the back plate 196 with a connecting mechanism. The back plate 196 has a base or foot 206 which extends out past the back plate and supports the backpack 190 in the standing position on any flat surface (ex: ground) making it easier to place the tank 102 into the platen 194 without the backpack 190 being worn by the carrier. The back plate 196 also supports special breathable foam and fabrics in the upper shoulder and lumbar regions for added comfort. The tank 102 can also be releasably attached to a support frame to be worn on the back of the user of the tank 102. This allows the user to more ergonomically use the device for long periods of time without having to lift and carry a heavily loaded tank 102. One such support frame is shown in FIGS. 12 and 13 but any suitable conventional support frame can also be used.

According to the provisions of the patent statutes, we have explained the principle, preferred construction and mode of operation of our invention and have illustrated and described what we now consider to represent its best embodiments. However, it should be understood that, within the scope of the appended claims, the invention may be practiced otherwise than as specifically illustrated and described.

We claim:

1. A pressurized sprayer comprising:

a tank configured to hold a quantity of liquid and having an opening to facilitate connection to a feed line for supplying the liquid to a spray nozzle; and a portable pump assembly releasably connected to the tank through a tank connector, wherein the portable pump assembly comprises an assembly housing having contained therein an electric pump, a switch assembly, and a connecting mechanism, wherein a first end of the connecting mechanism is connected to a dial and a second end of the connecting mechanism comprises a pump connector releasably connected to the tank connector, wherein the dial is attached to the connecting mechanism so that the dial and the pump connector of the connecting mechanism rotate as a single body without rotating the assembly housing, wherein the portable pump assembly directs a gas through a check valve contained within the connecting mechanism into the tank connector to increase a gas pressure in the tank and force the liquid in the tank to flow through the feed line and out the spray nozzle, and wherein the switch assembly turns off the electric pump when the gas pressure in the tank exceeds a predetermined limit while maintaining a flow of liquid through the spray nozzle.

2. The portable pressurized sprayer of claim 1, wherein, when the portable pump assembly is connected to the tank, the portable pump assembly is not rotatable or releasable until the dial is rotated.

3. The portable pressurized sprayer of claim 1, wherein the portable pump assembly comprises a portable power supply.

4. The portable pressurized sprayer of claim 3, wherein the portable power supply is rechargeable.

5. The portable pressurized sprayer of claim 1, wherein the tank comprises an interior surface and an exterior surface, wherein the exterior surface of the tank comprises a recessed portion for receiving the portable pump assembly such that the portable pump assembly is not rotatable.

6. The portable pressurized sprayer of claim 1, wherein the portable pump assembly comprises a port for receiving a power source.

7. The portable pressurized sprayer of claim 6, wherein the portable pump assembly comprises an outlet port for connecting a cable to provide power from the portable pump assembly to another device.

8. The portable pressurized sprayer of claim 1, wherein the gas is air.

9. The portable pressurized sprayer of claim 1, wherein, when the portable pump assembly is disconnected from the tank, the gas pressure within the tank is substantially maintained.

10. The portable pressurized sprayer of claim 1, wherein the pump connector of the connecting mechanism provides a push-on connection of the portable pump assembly to the tank connector, and rotation of the dial rotates the pump connector of the connecting mechanism to release the portable pump assembly from the tank connector.

11. The portable pressurized sprayer of claim 10, wherein the pump connector of the connecting mechanism includes flexible fingers that engage slots on the tank connector for the push-on connection in a first direction, wherein the slots prevent separation of the portable pump assembly from the tank connector via pulling in a second direction opposite the first direction.

12. The portable pressurized sprayer of claim 11, wherein rotating the dial moves nibs of the flexible fingers out of the slots on the tank so that the portable pump assembly can be disengaged from the tank connector by pulling in the second direction.

13. The portable pressurized sprayer of claim 11, wherein the first direction is axial to a direction of rotation of the dialing mechanism.

14. The portable pressurized sprayer of claim 1, wherein the dial extends to a first outer surface of the assembly housing and the pump connector extends to an opposing outer surface of the assembly housing.

15. The portable pressurized sprayer of claim 1, wherein the dial is releasably connected to the connecting mechanism.

16. A portable pressurized sprayer comprising:

a tank for holding a quantity of liquid, the tank having an opening to facilitate connection to a feed line for supplying the liquid to a spray nozzle;

a portable pump assembly releasably connected to the tank by a connecting mechanism comprising a pump connector configured to provide connection between the connecting mechanism of the portable pump assembly and a connector of the tank, wherein the portable pump assembly directs gas through a check valve contained within the connecting mechanism into the connector of the tank to increase a gas pressure in the tank and force the liquid in the tank to flow through the feed line and out the spray nozzle, and wherein the portable pump assembly comprises a switch assembly configured to turn off an electric pump of the portable pump assembly when the gas pressure in the tank exceeds a predetermined limit while maintaining a flow of liquid through the spray nozzle; and a support frame system for releasably attaching the tank and portable pump assembly, wherein the support frame system is configured to be supported on a user's back wherein the pump connector of the connecting mechanism includes flexible fingers that engage slots on the tank connector for a push-on connection in a first direction, wherein the slots prevent separation of the portable pump assembly from the tank connector via pulling in a second direction opposite the first direction.

17. The portable pressurized sprayer of claim 16, wherein rotating the connecting mechanism moves nibs of the flexible fingers out of the slots on the tank connector so that the portable pump assembly can be disengaged from the tank connector by pulling in the second direction.

18. The portable pressurized sprayer of claim 16, wherein the first direction is axial to a direction of rotation of the connecting mechanism.

19. A method for spraying liquid comprising the steps of:

a) releasably connecting a portable pump assembly to a tank holding a quantity of liquid, wherein the portable pump assembly comprises a housing having a connecting mechanism contained therein, wherein a first end of the connecting mechanism is connected to a dial and a second end of the connecting mechanism comprises a pump connector that can be releasably connected to the tank via a tank connector, wherein the dial is attached to the connecting mechanism so that the dial and the pump connector of the connecting mechanism rotate as a single body without rotating the housing, wherein the tank comprises an opening to facilitate connection to a feed line for supplying the liquid to a spray nozzle, and the portable pump assembly directs a gas through a check valve contained within the connecting mechanism into the tank connector to increase a gas pressure in the tank and force the liquid in the tank to flow through the feed line and out through the spray nozzle;

b) actuating an electric pump within the housing of the portable pump assembly to pump the gas through the connecting mechanism of the portable pump assembly through the tank connector, wherein a switch assembly of the portable pump assembly turns off the electric pump when the gas pressure in the tank exceeds a predetermined limit while maintaining a flow of the liquid through the spray nozzle; and c) disconnecting the portable pump assembly by rotating the dial and then removing the electric pump from the tank, wherein, when the portable pump assembly is disconnected from the tank, the gas pressure within the tank is substantially maintained.

* * * * *